US005090163A

United States Patent [19]

New

[11] Patent Number: 5,090,163

[45] Date of Patent: Feb. 25, 1992

[54] EASILY ACCESSIBLE SMOKE CURTAIN ASSEMBLY

[76] Inventor: Kevin New, 1604 Walnut Ave., Escalon, Calif. 95320

[21] Appl. No.: 484,395

[22] Filed: Feb. 23, 1990

[51] Int. Cl.[5] ..... E04B 5/52

[52] U.S. Cl. ..... 52/39; 52/484; 52/400

[58] Field of Search ..... 52/39, 484, 238.1, 239, 52/243.1

[56] References Cited

U.S. PATENT DOCUMENTS 3,675,382 7/1972 Lickliter et al. ..... 52/239

4,081,931 4/1978 Miyoshi ..... 52/39

*Primary Examiner*—Richard E. Chilcot, Jr.

*Assistant Examiner*—Joanne C. Downs

*Attorney, Agent, or Firm*—Poms, Smith, Lande & Rose

[57] ABSTRACT

A smoke curtain assembly includes an extruded main supporting member permanently mounted in a ceiling structure, a smoke shield, and an extruded shield holder which is securely but removably attached to an upper edge of the smoke shield. The smoke shield is removably mounted in the main supporting member by tilting the smoke shield and lifting it and the attached shield holder through a slot-like opening between two upward extending flanges on the main supporting member. By shifting and straightening the smoke shield and the shield holder, the shield holder bridges the slot-like opening and downward extending flanges of the shield holder abut the upward extending flanges on the main supporting member to prevent lateral movement of the shield holder and smoke shield. When the shield holder and smoke shield are thus removably mounted, fasteners are included to prevent vertical and longitudinal movement.

15 Claims, 2 Drawing Sheets

EASILY ACCESSIBLE SMOKE CURTAIN ASSEMBLY

BACKGROUND OF THE INVENTION

1. Field of the Invention

This invention relates to a smoke curtain of the type used in ceiling assemblies.

2. Description of Related Art

A smoke curtain is a device intended, in the event of a fire, to prevent smoke from rising rapidly in offices, escalators, atriums, or other open areas, and spreading throughout a multi-story building. In so doing, a smoke curtain increases the time for evacuation of people and equipment from floors above the level of the fire. An additional, more day-to-day advantage of certain smoke curtains is that they help lessen ceiling clutter.

In one type of smoke curtain arrangement used in ceiling assemblies, a sheet of glass or transparent plastic, which forms a smoke shield, is permanently installed in such a way that it extends downward perpendicular to the plane of the ceiling. With this type of prior art smoke curtain installation is quite time-consuming since the large individual glass sheets are very heavy, must be handled very carefully to avoid breakage. The sheets must then be bolted or screwed onto a ceiling fixture at several points along their length. The worker(s) normally must do so while standing on a ladder or platform. Also, if any of the installed sheets breaks, an entire section of the ceiling must normally be replaced in order to remove and replace the broken sheet. All of the above time-consuming installation difficulties create unnecessary expense and time. As with the installation problems, there is an attendant high cost of repair.

In another type of smoke curtain arrangement, a drywall soffit is used instead of a glass sheet to form the smoke shield which protrudes from the ceiling. Like the glass sheet, however, the drywall soffit is difficult to replace. In addition, dryuwall has even less structural integrity than glass. An additional disadvantage of the drywall soffit is that it is difficult to miter smoothly two sections of drywall where they must meet at an angle. Accordingly, the drywall is often aesthetically unappealing as compared to the interior designs of many modern commercial buildings.

Because of the difficulty of replacing known smoke curtains which use glass sheets and drywall soffits as smoke shields, it is normally unwise to use these shields themselves to support other ceiling components.

In addition to the poor accessibility of existing smoke curtains of glass and drywall, a further disadvantage of these known smoke curtains is that it is difficult or impossible to integrate them and their supporting structures into other ceiling assemblies such as ventilation air bars and sprinklers. This makes them particularly disadvantageous when it is necessary for the smoke curtain to round a corner.

SUMMARY OF THE INVENTION

The object of this invention is to provide a smoke curtain which 1) is easy to access and replace, yet which securely holds the smoke shields; 2) is easy to adapt to corners and angles while still being aesthetically pleasing; and 3) is easy to integrate into known ceiling structures.

The present invention accomplishes these objects, as well as others, by providing a continuous smoke curtain assembly which includes a unique extruded channel holder that may be mounted securely in a preexisting ceiling assembly. The invention also includes an extruded channel member which is adapted to mount securely in the channel holder, yet which is also adapted for easy removal therefrom. The invention removable coupling within the channel member for secure and quick mounting in and easy removal from a ceiling.

DESCRIPTION OF THE PREFERRED EMBODIMENT

Figure 1:
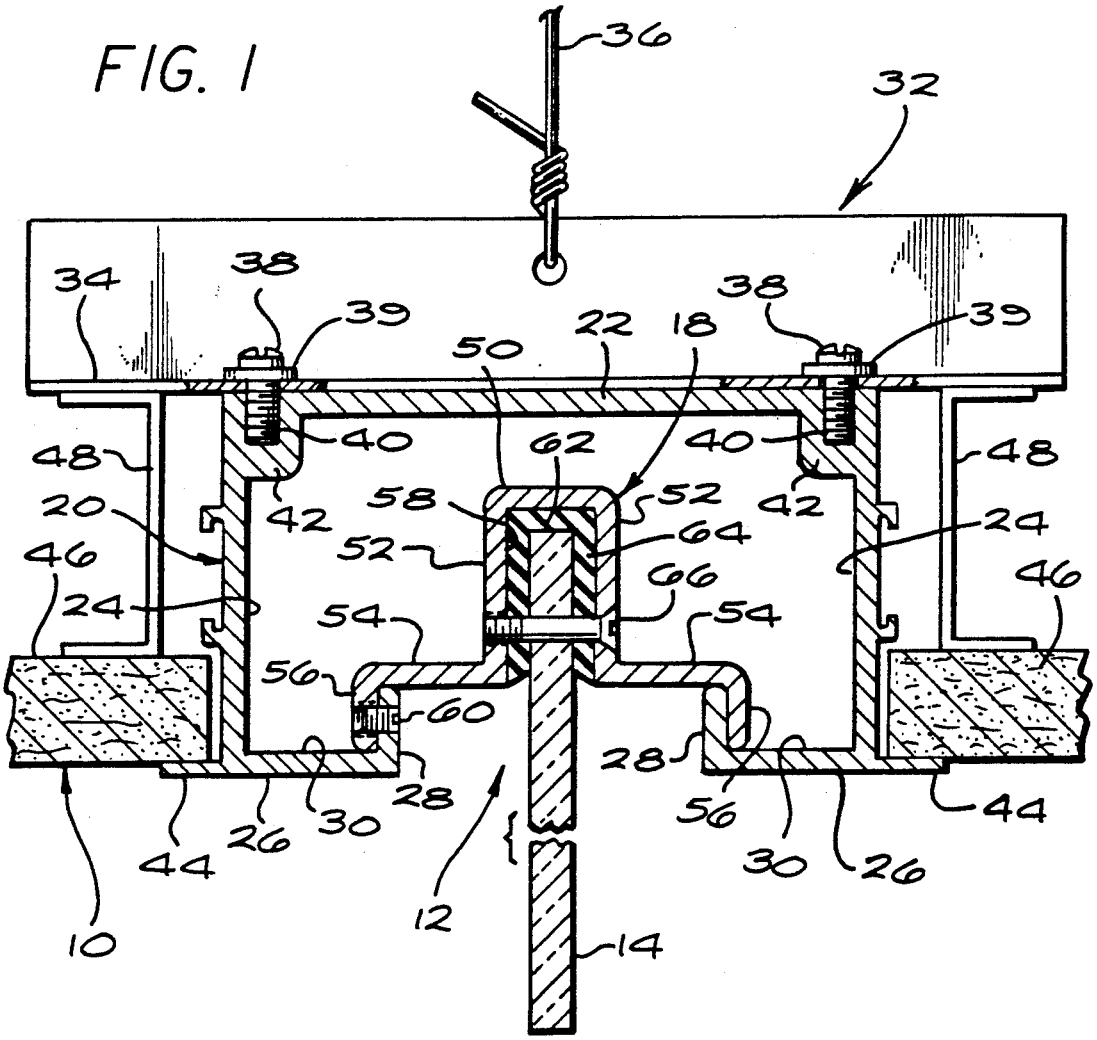
FIG. 1 is a sectional view of the smoke curtain assembly according to the invention, and also of an example of a ceiling structure in which the smoke curtain is mounted.

FIG. 1 illustrates a ceiling 10 in which a smoke curtain assembly 12 according to the invention is installed. For the sake of simplicity and clarity only, a substantially horizontal and planar ceiling is assumed; however, the invention is equally useful in inclined or irregularly shaped ceilings, as will be made clear below. The smoke curtain assembly 12 includes a smoke shield 14, which is formed as a sheet and extends downward mainly perpendicular to the ceiling 10. The smoke shield 14 is preferably made of glass, but other natural or synthetic materials such as plastic or wood may also be used. The thickness of the shields may also be allowed to vary.

As FIG. 1 illustrates, the smoke curtain assembly 12 according to the invention includes three main parts: the smoke shield 14, a shield holder 18, and a main supporting channel member 20. The shield holder 18 and the main supporting channel member 20 are preferably extruded members of aluminum; FIG. 1 is thus a sectional view taken perpendicular to the direction of extrusion. As FIG. 1 shows, the smoke shield 14 is secured in the shield holder 18, which in turn is removably mounted in the main channel member 20. In referring to FIG. 1 in this description, "inward" and "outward" refer respectively to the horizontal directions toward and away from the vertical plane mainly bisecting the main channel member 20, that is, toward and away from the smoke shield 14.

The main channel member 20 is generally rectangular in cross section, thus forming a continuous extruded channel opening downward, and has an upper wall 22 which extends mainly parallel to the plane of the ceiling 10, and two side walls 24 which extend downward substantially perpendicular to the upper wall 22. Ledge portions 26 of the main channel member 20 extend inward, generally parallel to the plane of the ceiling 10, and toward each other from each side wall 24. Opposing flanges 28 extend upward from the inner edges of each of the ledge portions 26. A slot-like opening extending in the direction of extrusion of the main channel member 20 is thus defined between the two flanges 28. A generally "U"-shaped channel 30 is defined on either side of the slot-like opening between each flange 28 and side wall 24 and is closed downward by the associated ledge portion 26.

By way of example, FIG. 1 illustrates a ceiling support structure commonly used in suspended ceilings. This support structure includes a bracket support angle 32 with a horizontal portion 34, and is attached by known means such as welding, screws, etc., to framing or is suspended from a hanger wire 36. Every ceiling includes some such supporting structure, and the smoke curtain assembly according to the invention can be installed easily in many different types of ceiling supporting structures. In the illustrated example, the main channel member 20 of the smoke curtain assembly 12 is securely attached to the bracket support angle 32 by fasteners such as screws 38 which are screwed through lock washers 39, the horizontal portions 34, and into holes 40 or recesses made in thickened portions 42 of the main channel member 20 formed at the corners where the side walls 24 join with the upper wall 22. The main channel member 20 thus is securely installed in the ceiling structure.

The main channel member 20 may also be provided with shelf portions 44 which extend parallel to the ledges portions 26, outwardly from each of the side walls 24. The shelf portion 44 and ledge portion 26 on either side preferably form a smooth surface viewed from below. In a typical suspended ceiling, the shelf portions 26 provide support for the edges of drywall panels 46 which in some know ceiling structures are vertically restrained by angle spacers 48. Since drywall panels normally are laid on similar shelf portions on the rails of a ceiling grid member or on the flanges of an air bar, ceilings can be outfitted with the main channel member 20 of the smoke curtain assembly according to the invention without any unfamiliar, complicated or costly modifications. As is explained below in greater detail, the shelf portions 44 are not limited to supporting drywall panels, but may be adapted to fit with corresponding portions of adjacent ceiling assemblies.

In FIG. 1, the smoke curtain assembly 12 is shown in a mounted, fully assembled position, which is the reference position for the description of the shield holder 18; the shield holder 18 is removable. The shield holder 18 has a substantially horizontal upper wall 50, side walls 52 which extend downward from the upper wall 50, leg portions 54 which extend mainly horizontally outward from the respective side walls 52, and feet 56 which extend downward as flanges from the leg portions 54. An extruded shield channel 58 shaped generally as an inverted "U" is thereby defined between the side walls 52 and is closed upward by the upper wall 50. The distance between the innermost surfaces of the feet 56 is preferably approximately equal to or slightly greater than the distance between the outermost surfaces of the flanges 28. When the shield holder 18 is mounted in the main channel member 20, as is shown in FIG. 1, the shield holder 18 therefore bridges the slot-like opening between the flanges 28, whereby the flanges 28 and feet 56 prevent lateral movement of the shield holder 18 and smoke shield 14.

The shield holder 18 is preferably secured along its length to the main channel member 20 by tensioning elements such as sunken Allen head tension screws 60. In the example illustrated in FIG. 1, the tension screws 60 are screwed through one of the flanges 28 and into the foot 56 on the same side as the flange. Note that it is not necessary to secure both feet 56 to the adjacent flanges 28. The one tension screw 60 will normally suffice to restrain longitudinal and vertical movement of the shield holder 18 in the main channel member 20, and also to restrain lateral movement more positively than the flange 28 / foot 56 contact alone. Because of the open space between the smoke shield 14 and the flanges 28, the tension screw 60 can easily be tightened when the shield holder 18 is mounted on the main channel member 20.

The smoke shield 14 is mounted in the shield holder 18 by inserting its upper edge 62 into the shield channel 58. Where the smoke shield is chosen to be of a brittle material such as glass, a protective spacing insert or material 64 is preferably provided to line the shield channel 58 to protect the upper edge 62 of the smoke shield 14; otherwise, the glass edge would bear directly against the metal of the shield holder. Even in applications using smoke shields of less fragile material such as plastic or wood, the spacing insert may serve as a lining insert of varying thickness to allow smoke shields of different thicknesses to be used without having to change the shield holder 18 itself. The smoke shield 14 is secured in the shield channel 58 along its length by fasteners such as retaining pins or screws 66, each of which is screwed into a preferably countersunk hole in one side wall 52 of the shield holder 18, through one side of the spacing insert 64, through the smoke shield 14, through the other side of the spacing insert, and into the other side wall 52.

In FIG. 1, the shield holder 18 and smoke shield 14 are shown mounted securely in the main channel member 20. A unique feature of the smoke curtain according to the invention is its accessibility and replaceability of the smoke shield. In order to replace the smoke shield 14, a worker first loosens the tension screws 60 along the length of the smoke shield 14. By lifting the smoke shield, the shield holder 18 is then lifted until the feet 56 are clear of the flanges 28. Still grasping the smoke shield 14, the worker then shifts the shield holder 18 to one side, tilts it, and guides it through the slot-like opening between the flanges 28. The width of the slot-like opening, that is, the distance between the flanges 28, is determined relative to the vertical extension of the shield holder 18 so that normal angles of tilt will be sufficient to allow the shield holder to pass easily through the slot-like opening when tilted and shifted. This width may be easily determined by calculations using other desired dimensions of the smoke curtain assembly and the desired geometry of a particular application. The smoke shield 14 may then be removed safely and quickly from the shield holder 18 by removing the retaining pins or screws 66.

A replacement smoke shield is of course quickly installed in the ceiling by carrying out these steps in the reverse order. Using smoke curtains according to the prior art, every time one needed to replace a smoke shield, much time-consuming and expensive labor was required; in some cases entire sections of the ceiling must be replaced. In contrast, with this invention, after the one-time installation of the main channel member 20, a smoke shield may be replaced quickly and cheaply by loosening only a few screws and by simple shift-and-tilt motions.

Figure 2:
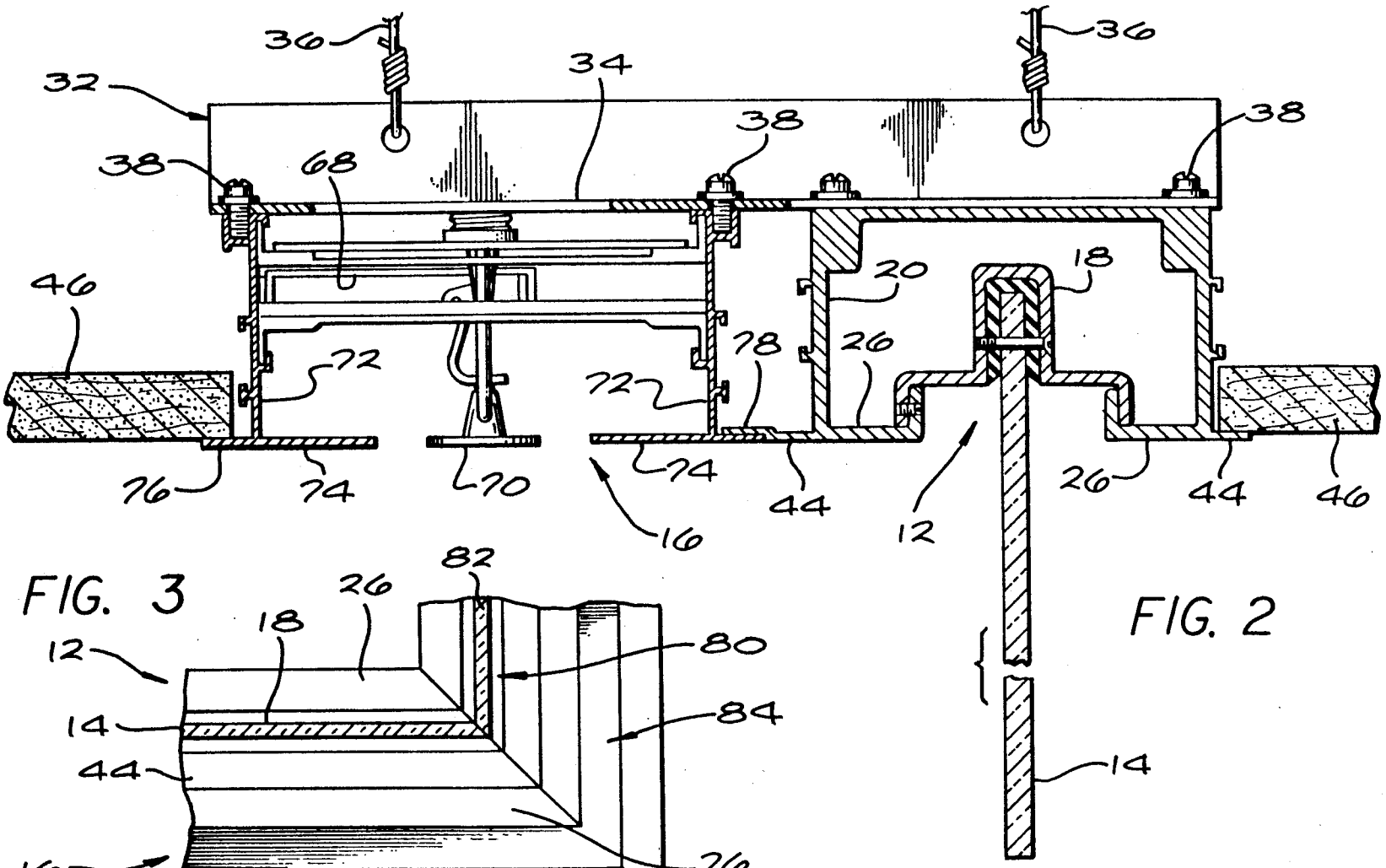
FIG. 2 illustrates the manner in which the smoke curtain according to the invention may be integrated into a ceiling structure together with other types of ceiling assemblies.

FIG. 2 shows the way in which the smoke curtain assembly 12 can be integrated into a ceiling structure immediately adjacent to another ceiling assembly. A separate ceiling assembly is indicated generally by the reference numeral 16. The function of the separate assembly is not relevant to this invention, but by way of example, a ventilation assembly such as an air bar combining an air weir 68 and sprinkler heads 70 is shown in FIG. 2. In the illustrated example, these components are mounted in and between extruded brackets 72. On either side of the ventilation opening in which the sprinkler head 70 is shown, the brackets 72 include inner flanges 74 which extend inward toward each other to delimit the ventilation opening, and side flanges 76 which extend outward away from each other and from the sprinkler head 70. The side flange 76 to the left (viewed as in FIG. 2) supports one of the drywall panels 46 as in a conventional suspended ceiling.

In this exemplifying embodiment, the main channel member 20 of the smoke curtain assembly 12 according to the invention preferably includes an extension 78 at the outer edge of and substantially parallel to the left shelf portion 44. The distance from the underside of the extension 78 to the underside of the left shelf portion 44 is preferably approximately equal to the thickness of the side flange 76. When the ceiling assembly 16 is installed immediately adjacent to the smoke curtain assembly 12, the side flange 76 is fitted under the extension 78 and abutting the outer edge of the shelf portion 44, thus sealing the ceiling along the line where the two assemblies meet. Viewed from below, the side flange 76 and the extension 78 thereby also give an attractive, even appearance. If these advantages of the extension 78 are not required, it may of course be deleted from the extrusion die without lessening the other advantages of the smoke curtain assembly according to the invention.

Figure 3:
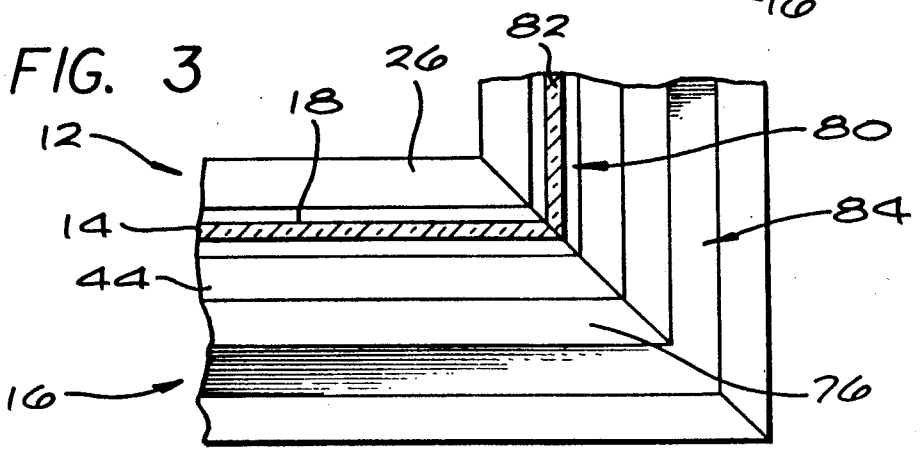
FIG. 3 illustrates one way in which the smoke curtain according to the invention may be adapted to round a corner and to follow changes in direction of other types of ceiling assemblies.

FIG. 3 is a view from below of a joint installation of the smoke curtain assembly 12 according to the invention and another ceiling assembly 16 such as the air bar (without sprinklers) illustrated in FIG. 2. FIG. 3 shows the smooth transition which is possible between the visible portions of these two assemblies. FIG. 3 also shows a second smoke curtain assembly 80, which has a second smoke curtain 82 and which is essentially identical to the smoke curtain assembly 12. As FIG. 3 illustrates, since the smoke curtain assemblies 12, 80 consist preferably of easily cut aluminum extrusions and glass, plastic or wood, this invention allows for easy and smooth mitering of assemblies to turn not only 90-degree corners as illustrated in the figure, but any angle likely to be called for in a modern ceiling. Where other ceiling assemblies 16 are also extruded and easily mitered, the FIG. 3 also shows that a smooth, attractive, gap-free corner is also easily arranged with both these assemblies and the smoke curtain assemblies 12, 80 using the embodiment shown in FIG. 2. Note that the accessibility of the smoke shields 14, 82 is not impaired by mitering and installation immediately adjacent to another ceiling assembly: The same shift-and-tilt operation as described above may still be used to replace either shield.

Figure 4:
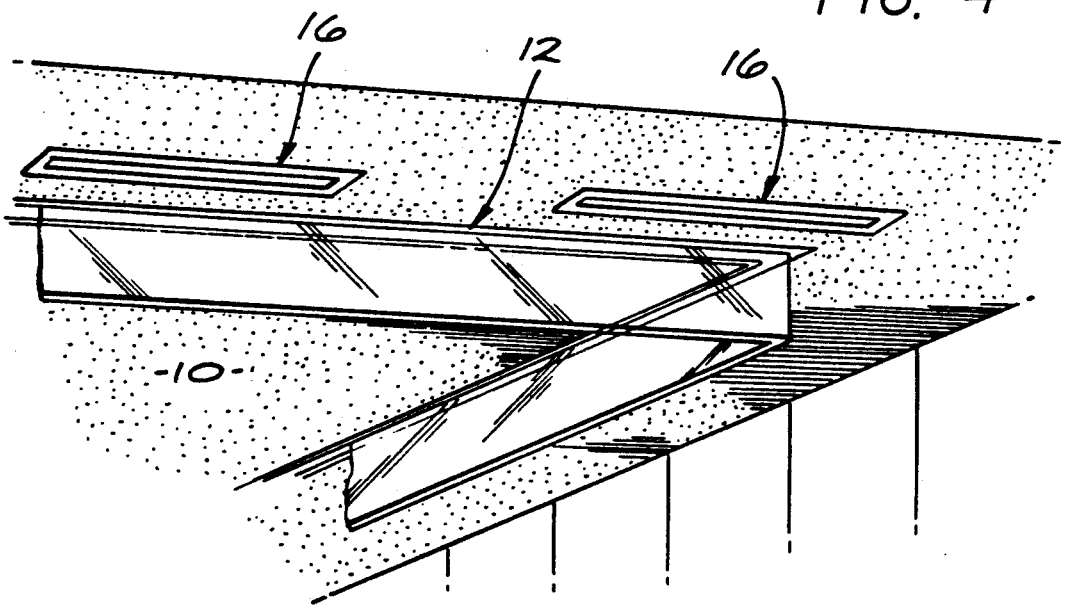
FIG. 4 illustrates generally an example of a ceiling in which a smoke curtain according to the invention is installed.

FIG. 4 illustrates more generally the ceiling 10 in which the smoke curtain assembly 12 according to the invention are installed. In FIG. 4, two separate smoke shields 14 are mitered at one end as in FIG. 3 to form an angle. As above, for the sake of simplicity and clarity only, a substantially horizontal and planar ceiling is assumed, but one should recall that the invention is equally useful in inclined or irregularly shaped ceilings, as will be made clear below. In the example illustrated in FIG. 4, the smoke shields are substantially clear, but they may also be tinted or opaque, in whole or in part. The invention allows the interior designer or architect the freedom to choose the material and appearance of the smoke shields 14; indeed, because the smoke shields according to the invention may be changed easily, the shields themselves may be chosen to be an attractive element in an interior design, or may be used to support advertising or other displays.

In the illustrated example, other ceiling assemblies 16 such as ventilation outlets are also installed in the ceiling 10. These other assemblies 16 are not essential to the invention, and if they are included in a ceiling structure it is not necessary for there to be a space between them and the smoke curtain assembly 12 according to the invention. The manner in which the smoke curtain assembly 12 according to the invention can be readily integrated with such other assemblies is described above in connection with the discussion of FIG. 3.

Referring once again to FIG. 1, in an actual prototype of the invention, the maximum width of the main member 20 (from tip to tip of the shelf portions 44) was approximately 4½ inches, the maximum height being roughly 2 3/16 inches. Each shelf portion 44 extended about ⅛ inch from its respective side wall 24. the slot-like opening between the flanges 28 was roughly 1¾ inches wide, with the flanges 28 themselves extending approximately ½ inch upward from the lower plane of the ledge portions 26. The walls and flanges of the main member 20 and of the shield holder 18 were approximately ⅛ inch thick aluminum extrusions. The smoke shield 14 was made of tempered glass roughly ¼ inch thick and 18 inches high. The shield channel was approximately 1 inch deep and ½ inch wide.

In an actual installation, smoke curtain assemblies according to the invention were mitered to form acute, obtuse and right-angled corners and were installed both freestanding as shown in FIGS. 1 and 4, and integrated with linear air bars as shown in FIGS. 2 and 3. This particular installation included smoke curtain assemblies as long as ten feet a piece and as short as approximately one foot.

The invention is of course not limited to the embodiments and alternatives described above. Although the shield holder 18 with the shield channel 58 has been found to provide exceptionally simple and secure mounting and protection for the upper edge of the smoke shield 14, other means of securing the shield are possible. For example, the shield holder could be designed as a simple inverted "U" channel, whereby screws are screwed vertically through it into horizontal flanges on a mounting bracket attached securely to the upper edge of the smoke shield. Such an alternative arrangement would, however, be more complicated, require more installation steps, and another part, and would probably be less secure and less attractive.

According to the invention, lateral movement of the smoke shield 14 and the shield holder 18 is prevented by the flange-like feet 56 bearing against the flanges 28. As alternatives, the flanges and feet could be deleted, and the lower surface of the leg portions 54 (which would be made wider) and the upper surface of the ledge portions 26 could be provided with mating grooves, or the lower surface of the leg portions could be provided with protrusions which fit just inside the inner edges of the ledge portions. These arrangements would, however, not prevent vertical and longitudinal movement since there would be nowhere to put retaining elements such as the screws 60.

Furthermore, although the invention is intended primarily to provide an assembly which enables quick and efficient installation and removal of smoke shields, as is pointed out above, the shield may also be used simply to support displays such as advertisements, even where there is no need for protection against rising smoke. The invention would allow equally quick and efficient installation and removal of such displays, of rigid partitioning walls, etc.

Although the main supporting member 20 is preferably a single extruded element, the upper wall 22 is not necessary to removably mount the smoke shield and shield holder. Instead, separate brackets could be used, as in the ventilation assembly shown in FIG. 2, whereby each bracket would have a profile including one half of the main member 20, exclusive of the upper wall. If separate brackets are used, however, proper spacing between the flanges 28 must be insured.

What is claimed is:

1. A smoke curtain assembly including:

a) a substantially planar smoke shield having an upper edge and a lower edge;

b) a shield holder secured to the upper edge only of the smoke shield for securely holding the smoke shield;

c) a main supporting member including:

i) main mounting means for securely attaching the main supporting member to a support structure in a ceiling delimited substantially by a ceiling plane; and ii) inwardly-extending holder support means for supporting the shield holder in an installed position; and d) said shield holder including outwardly-extending support means for removably installing the smoke shield in the main supporting member and for resting on the inwardly-extending holder support means of the main supporting member when in the installed position.

2. A smoke curtain assembly as defined in claim 1, in which:

the main supporting member is an extruded member with opposing main side walls and ledge portions extending substantially parallel to the ceiling plane toward each other from bottom edges of the main side walls;

the shield holder is an extruded member having opposing holder side walls joined by a holder upper wall, for forming a shield channel; and shield fastening means is provided for removably securing an attachment edge of the smoke shield in the shield channel.

3. A smoke curtain assembly as defined in claim 2, including lateral restraining means for restraining the shield holder member and the smoke shield against the lateral movement when in a mounted position in the main supporting member.

4. A smoke curtain assembly as defined in claim 3, said lateral restraining means including: inner flanges extending upward from inner edges of the ledge portions of the main supporting member; holder leg portions extending laterally from lower edges of each of the holder side walls; and holder flanges extending downward from outer edges of each of the holder leg portions;

said shield holder member bridging a slot-like opening formed between said inner flanges when the holder member is in the mounted position, with said holder flanges abutting said inner flanges, each said holder flange being substantially located in a retaining channel defined between a corresponding one of said main side walls and the associated inner flange, the retaining channel being closed downward by the corresponding leg portion.

5. A smoke curtain assembly as defined in claim 4, including removable, vertical restraining means for restraining the shield holder member and the smoke shield against vertical movement when in the mounted position in the main supporting member.

6. A smoke curtain assembly as defined in claim 5, said vertical restraining means comprising a fastener extending through one of said inner flanges and into the corresponding one of said holder flanges.

7. A smoke curtain assembly as defined in claim 2, in which the main supporting member and shield holder each have at least one mitered end, said smoke shield also having at least one mitered end, for forming smooth mitered joints between connecting smoke shields.

8. A smoke curtain assembly as defined in claim 4, the width of said slot-like opening being larger than the horizontal extension of said shield holder when said shield holder and smoke shield are in a tilted mounting position.

9. A smoke curtain assembly as defined in claim 2, further including spacing means disposed between the attachment edge of the smoke shield and the shield holder member for protecting and spacing the attachment edge in the shield channel.

10. A smoke curtain assembly as defined in claim 2, each shield fastening means comprising at least one shafted fastening element extending through both holder side walls and through the smoke shield.

11. A smoke curtain assembly as defined in claim 10, each said shafted fastening element comprising a screw, which is countersunk in one of said holder side walls and is screwed into a corresponding threaded hole in the other one of said holder side walls.

12. A smoke curtain assembly as defined in claim 2, said main supporting member including edge joining means for gap-free mating with a mounting flange on a secondary ceiling assembly.

13. A smoke curtain assembly as defined in claim 12, said edge joining means comprising a shelf flange portion and an extension portion, both extending laterally substantially parallel to the ceiling plane, said extension portion being raised relative to said shelf flange portion to form a receiving recess for the mounting flange on the secondary ceiling assembly.

14. A smoke curtain assembly including:

a main supporting means including means for securely attaching the main supporting means to a support structure in a ceiling delimited substantially by a ceiling plane;

a substantially planar smoke shield; and shield holder means for securely holding the smoke shield and for removably mounting the smoke shield in the main supporting means;

said main supporting means consisting of an extruded main supporting member having opposing main side walls and ledge portions extending substantially parallel to the ceiling plane toward each other from bottom edges of the main side walls;

said shield holder means including an extruded shield holder member having opposing holder side walls joined by a holder upper wall, for forming a shield channel; and in which shield fastening means is provided for removably securing an attachment edge of the smoke shield in the shield channel; and said shield fastening means comprises at least one shafted fastening element extending through both holder side walls and through the smoke shield.

15. A smoke curtain assembly including:

a main supporting means including means for securely attaching the main supporting means to a support structure in a ceiling delimited substantially by a ceiling plane;

a substantially planar smoke shield; and shield holder means for securely holding the smoke shield and for removably mounting the smoke shield in the main supporting means;

said main supporting means consisting of an extruded main supporting member having opposing main side walls and ledge portions extending substantially parallel to the ceiling plane toward each other from bottom edges of the main side walls;

said shield holder means including an extruded shield holder member having opposing holder side walls joined by a holder upper wall, for forming a shield channel; and in which shield fastening means is provided for removably securing an attachment edge of the smoke shield in the shield channel;

said shield fastening means comprises at least one shafted fastening element extending through both holder side walls and through the smoke shield; and each said shafted fastening element comprises a screw, which is countersunk in one of said holder side walls and is screwed into a corresponding threaded hole in the other one of said holder side walls.

* * * * *